US009340331B2

(12) United States Patent
Shimono

(10) Patent No.: US 9,340,331 B2
(45) Date of Patent: May 17, 2016

(54) BEVERAGE CONTAINER HAVING HIGH SEALABILITY AND AN EASY TO OPEN LID

(71) Applicant: ATHENA KOUGYOU KABUSHIKI KAISHA, Seki-shi, Gifu (JP)

(72) Inventor: Taisuke Shimono, Seki (JP)

(73) Assignee: ATHENA KOUGYOU KABUSHIKI KAISHA, Gifu (JP)

( * ) Notice: Subject to any disclaimer, the term of this patent is extended or adjusted under 35 U.S.C. 154(b) by 0 days.

(21) Appl. No.: 14/605,417

(22) Filed: Jan. 26, 2015

(65) Prior Publication Data

US 2015/0216341 A1 Aug. 6, 2015

(30) Foreign Application Priority Data

Feb. 4, 2014 (JP) ..... 2014-019494

(51) Int. Cl.
*B65D 43/02* (2006.01)
*B65D 85/72* (2006.01)
*A47G 19/22* (2006.01)

(52) U.S. Cl.
CPC ..... *B65D 43/0229* (2013.01); *B65D 85/72* (2013.01); *B65D 2543/00046* (2013.01); *B65D 2543/0049* (2013.01); *B65D 2543/00092* (2013.01); *B65D 2543/00296* (2013.01)

(58) Field of Classification Search
CPC .... B65D 47/265; B65D 47/261; B65D 41/04; B65D 43/0229; B65D 43/0225; B65D 85/72; B65D 81/3876; B65D 85/804; A47G 19/2272; A47G 23/0216; A47G 23/0208
USPC ..... 220/212.5, 293, 300, 301, 805, 797, 220/253, 796, 801, 713, 711, 738, 737, 812, 220/715, 714, 821; 229/404
See application file for complete search history.

(56) References Cited

U.S. PATENT DOCUMENTS 3,173,571 A * 3/1965 Cserny ..... B65D 43/021 220/203.9
2011/0006062 A1 1/2011 Bratsch

FOREIGN PATENT DOCUMENTS

WO WO-01/12031 A1 2/2001
WO WO 02083516 A1 * 10/2002 ..... B65D 43/021

* cited by examiner

*Primary Examiner* — Robert J Hicks
(74) *Attorney, Agent, or Firm* — Cheng Law Group, PLLC

(57) ABSTRACT

The beverage container is provided with a cup-like container main body which is provided with an inner circumference sliding part provided on the inside of an upper opening and an outer circumference flange part extending on the outside of the inner circumference sliding part, and a lid body which is provided with an inner fitting part detachably and rotatably attached to the inner circumference sliding part and the outer circumference flange part of the container main body. Two pouring recesses made by partial recesses for pouring out the beverage from inside the container main body are formed in the inner circumference sliding part and the outer circumference flange part of the container main body, and a drinking hole connecting part is formed to be registered with a pouring recess of the container main body in accordance with the rotation of a rotary knob of the lid body.

10 Claims, 11 Drawing Sheets

BEVERAGE CONTAINER HAVING HIGH SEALABILITY AND AN EASY TO OPEN LID

BACKGROUND OF THE INVENTION

1. Field of the Invention

The present invention relates to a beverage container, more particularly relates to a beverage container with high sealability which prevents leakage of the contents and which is provided with a lid which is easy to open.

2. Description of the Related Art

Usually, when buying a drink to take out or the like, after the drink is poured into a container such as a cup, a lid is affixed thereto. This is to prevent the contained drink from spilling when the cup is shaken when taking the drink home. When the lid completely seals the opening part of the cup, it is effective at preventing the spillage of the content. However, the lid must be removed when you want a drink which is troublesome. Further, there is the possibility that the drink will be spilled when removing the lid. It would be convenient if once the lid is affixed to the container, you could drink the contained beverage with as much of the lid covering the container as possible.

For example, a cup provided with a lid with an elongate protrusion like a beak as a mouthpiece has been suggested (refer to patent reference 1). A small hole is formed for the beverage in the mouthpiece protruding from the lid of the cup according to patent reference 1. Thus, in a state of the cup having the lid affixed, even if the cup is knocked onto its side or turned upside down, there will be little flow of liquid (the beverage) from the small hole in the mouthpiece. However, the cup according to patent reference 1 is mainly aimed at infants, and the amount of liquid which can flow through the small hole in the mouthpiece is small. Suppose that the opening of the small hole were to be made wider, the effect of controlling the flow of liquid would be lost. Based on this, a cup with good sealability of a liquid inside is difficult to make for the general public.

With this in mind, a lid provided with an operation means for opening and closing the opening part for pouring a liquid into a container such as a cup has been suggested (patent reference 2). The structure of the lid of patent reference 2 allows the opening part of the cup for pouring a liquid into, to be made large, moreover the lid can be opened and closed and the usability is improved. However, the result is a more complex structure of the lid and the product unit price could easily rise. The premise being that the lid of patent reference 2 is not intended to be disposable but will be used many times.

The present situation in the case of the majority of containers used for takeout beverages is that a lid with a dome-like bulged part is used to cover the opening of the containers such as paper cups. A user places his or her mouth onto the bulged part and drinks the beverage in the container through the flow hole provided in the tip of the bulged part. However, the sealability between the cup and the lid of the existing containers is not sufficient and countermeasures against spillage have been rushed. Further, when drinking the beverage with the lid attached, the height of the bulged part is added to the height of the container making it difficult to get a feeling for the actual surface of the beverage relative to the incline of the container. It has been pointed out that especially in the case of hot beverages, the amount a container needs to be tilted cannot be judged and hot beverage is unintentionally swallowed.

In view of the above-mentioned facts, the demand is high for a novel container which can easily prevent the beverage contained within from spilling, can be produced at a low cost and further, approaches the sensation of drinking the beverage from a cup.

As related art, see the WO01/012031 (corresponding to Japanese Unexamined Patent Publication (Kohyo) 2003-506179) and WO2009/103817 (corresponding to Japanese Unexamined Patent Publication (Kohyo) 2011-512304).

SUMMARY OF THE INVENTION

In view of the aforementioned points, the present invention provides a novel beverage container with a lid, which is used when selling beverages, which easily prevents the beverage contained therein from spilling, can be manufactured at a low cost, is extremely easy to use and which approaches the feeling of drinking from a cup.

Namely, the aspect of the invention of claim 1 provides a beverage container comprising a cup-like container main body which is provided with an inner circumference sliding part provided on the inside of an upper opening and an outer circumference flange part extending on the outside of the inner circumference sliding part, and a lid body which is provided with an inner fitting part detachably and rotatably attached to the inner circumference sliding part and the outer circumference flange part of the container main body, wherein a pouring recess composed of a partial recess for pouring out a beverage contained in the container main body is formed in the inner circumference sliding part and the outer circumference flange part of the container main body, and a drinking hole connecting part is formed corresponding to the pouring recess of the container main body in accordance with the rotation of the lid body.

The aspect of the invention of claim 2 provides the beverage container according to claim 1 wherein, the container main body is provided with two pouring recesses which are opposed to each other, and the lid body is provided with the drinking hole connecting part corresponding to one of the pouring recesses and an outside air connecting part corresponding to the other pouring recess.

The aspect of the invention of claim 3 provides the beverage container according to claim 1 wherein the lower part diameter of the inner circumference sliding part is larger than the upper part diameter of the inner circumference sliding part, and, the lower part diameter of the inner fitting part is larger than the upper part diameter of the inner fitting part, the inner fitting part of the lid body is fitted to the inside of the inner circumference sliding part of the container body.

The aspect of the invention of claim 4 provides the beverage container according to claim 1 wherein the lid body is provided with a rotary knob for rotating the lid body.

The aspect of the invention of claim 5 provides the beverage container according to claim 1 wherein an air discharge part is formed in the lid body.

The aspect of the invention of claim 6 provides the beverage container according to claim 1 wherein the lid body is provided with an opening and closing tab which can be adapted to remove said lid body.

The aspect of the invention of claim 7 provides the beverage container according to claim 1 wherein the lid body is provided with an auxiliary stepped part formed on the surface thereof.

The aspect of the invention of claim 8 provides the beverage container according to claim 1 further comprising a sleeve which covers the outer peripheral surface of the body part of the container main body.

The aspect of the invention of claim 9 provides the beverage container according to claim 1 wherein the beverage container is for hot beverages.

The aspect of the invention of claim 10 provides the beverage container according to claim 1 wherein the beverage container is disposable.

Advantageous Effect of the Invention

According to the beverage container according to claim 1, as there is provided a beverage container comprising a cup-like container main body which is provided with an inner circumference sliding part provided on the inside of an upper opening and an outer circumference flange part extending on the outside of the inner circumference sliding part, and a lid body which is provided with an inner fitting part which is detachably and rotatably attached to said inner circumference sliding part and said outer circumference flange part of said container main body, wherein a pouring recess composed of a partial recess for pouring out a beverage contained in said container main body is formed in said inner circumference sliding part and said outer circumference flange part of said container main body, and a drinking hole connecting part is formed corresponding to said pouring recess of said container main body in accordance with the rotation of said lid body, it is possible that the container which is provided with the lid body used when drinks are being sold, will allow the beverage not to easily spill from inside the container, can be completed at a low cost, can be used extremely simply and the feeling of drinking approaches that of using a cup.

According to the beverage container according to claim 2, as there is provided a beverage container wherein, the container main body is provided with two pouring recesses which are opposed to each other, and the lid body is provided with the drinking hole connecting part corresponding to one of the pouring recesses and an outside air connecting part corresponding to the other pouring recess, it is possible to pour the beverage out of one of the pouring recesses while the other pouring recess forms a channel for air.

According to the beverage container according to claim 3, as there is provided a beverage container wherein the lower part diameter of the inner circumference sliding part is larger than the upper part diameter of the inner circumference sliding part, and, the lower part diameter of the inner fitting part is larger than the upper part diameter of the inner fitting part, the inner fitting part of the lid body is fitted to the inside of the inner circumference sliding part of the container body, it is possible to improve the airtightness of the container and the beverage becomes more difficult to spill out of the container. At the same time, a click can be sensed when affixing the lid body.

According to the beverage container according to claim 4, as there is provided a beverage container wherein the lid body is provided with a rotary knob for rotating the lid body, it is possible for a user to rotate the lid body with a finger pushing the rotary knob thus rotating the lid is extremely easy.

According to the beverage container according to claim 5, as there is provided a beverage container wherein an air discharge part is formed in the lid body, it is possible for steam to escape and the pressure inside the container is reduced.

According to the beverage container according to claim 6, as there is provided a beverage container wherein the lid body is provided with an opening and closing tab which can be adapted to remove the lid body, it is possible to remove the lid easily by pulling up the opening and closing tab.

According to the beverage container according to claim 7, as there is provided a beverage container wherein the lid body is provided with an auxiliary stepped part formed on the surface thereof, it is possible to further enhance the fittability of the inner circumference sliding part of the container main body and the inner fitting part of the lid body.

According to the beverage container according to claim 7, as there is provided a beverage container further comprising a sleeve which covers the outer peripheral surface of the body part of the container main body, it is possible to inhibit heat conduction from the cup main body.

According to the beverage container according to claim 9, as there is provided a beverage container wherein the beverage container is for hot beverages, wherein the degree the container is inclined is the same as the container main body, it is possible to effectively deal with inconveniences such as inclining the container more than necessary and spilling the beverage or unintentionally swallowing the hot beverage.

According to the beverage container according to claim 10, as there is provided a beverage container wherein the beverage container is disposable, it is suitable for the purpose of takeout drinks and as it is only used once it is hygienic.

DESCRIPTION OF THE PREFERRED EMBODIMENTS

Figure 1:
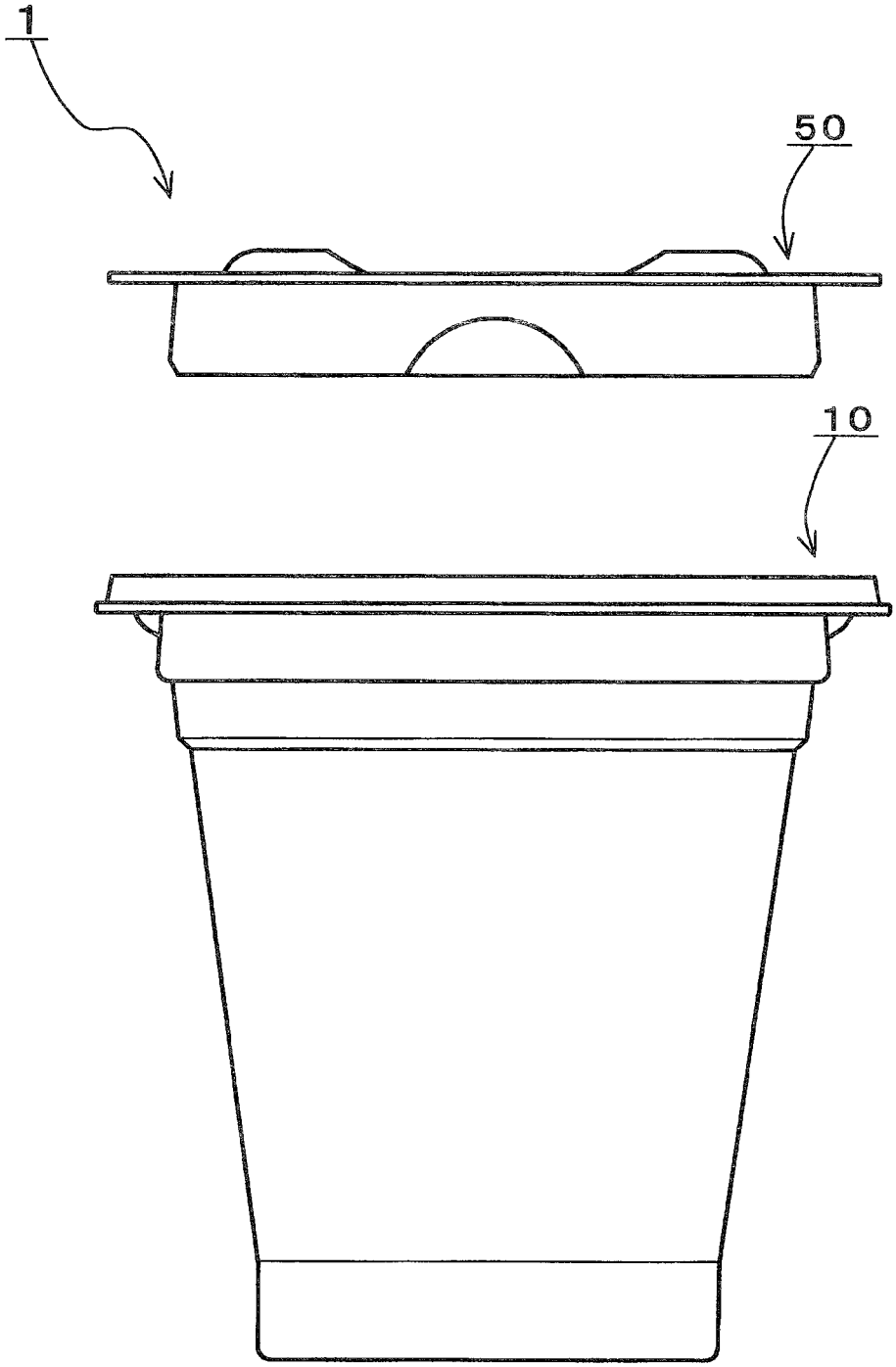
FIG. 1 is a lateral view showing the container main body and the lid body of the beverage container separated therefrom according to the invention.

As can be seen in FIG. 1, a beverage container 1 is comprised of a container main body 10 and a lid body 50. The beverage container 1 is a container with a lid which will mainly be used for the sale of beverages at convenience stores, supermarkets, department stores or restaurants as well as being provided at buffets and used by outside caterers, food suppliers, food delivery services etc. The container main body 10 is filled with a beverage, the lid 50 is affixed thereto and is provided to the customer. Moreover, the provision of the lid 50 means that the beverage contained in the beverage container 1 is difficult to spill. Further, as will be mentioned later, the lid 50 has a feature which allows a beverage to be drunk with a simple operation. To begin with, a description of the structure of the beverage container 1 will be given based on the drawings.

Figure 2:
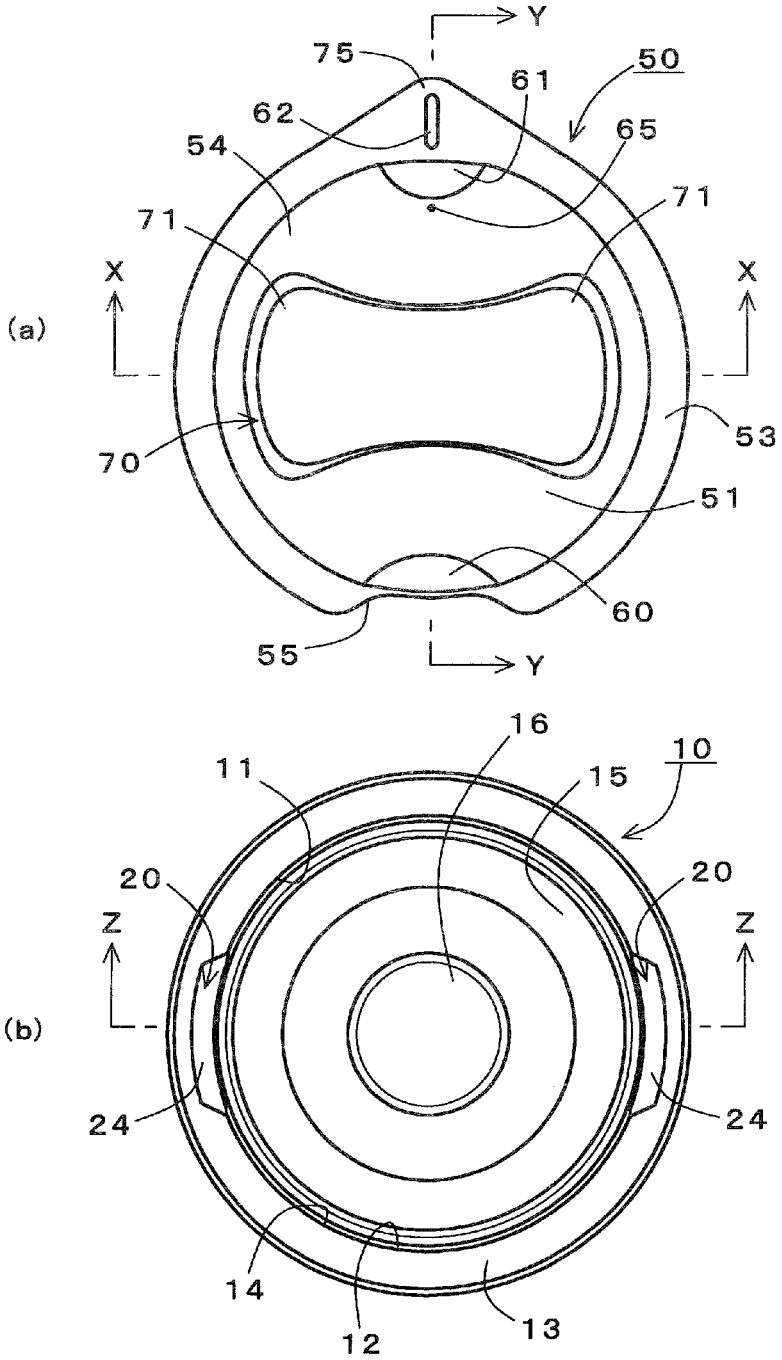
FIG. 2 is a plan view of the container main body and the lid main body.
Figure 3:
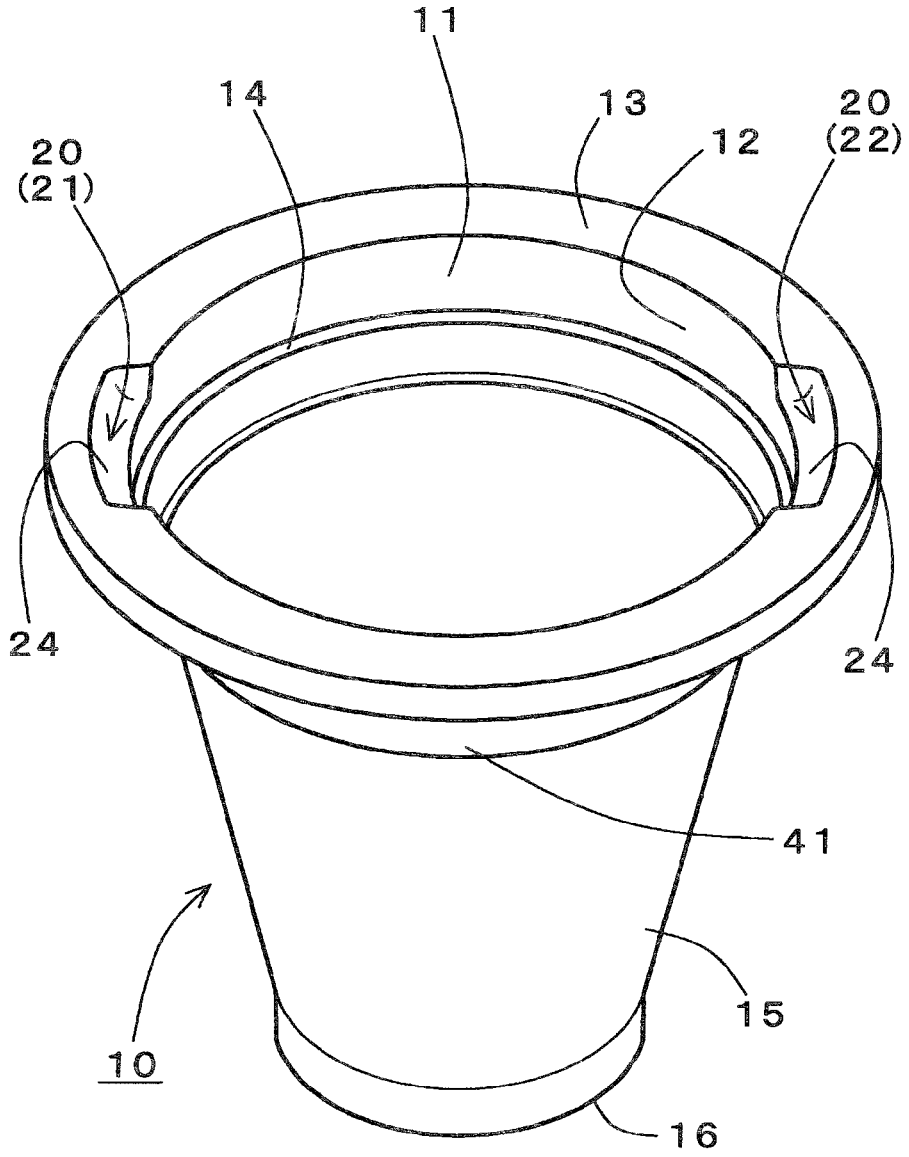
FIG. 3 is a perspective view showing the whole container main body according to the invention.
Figure 7:
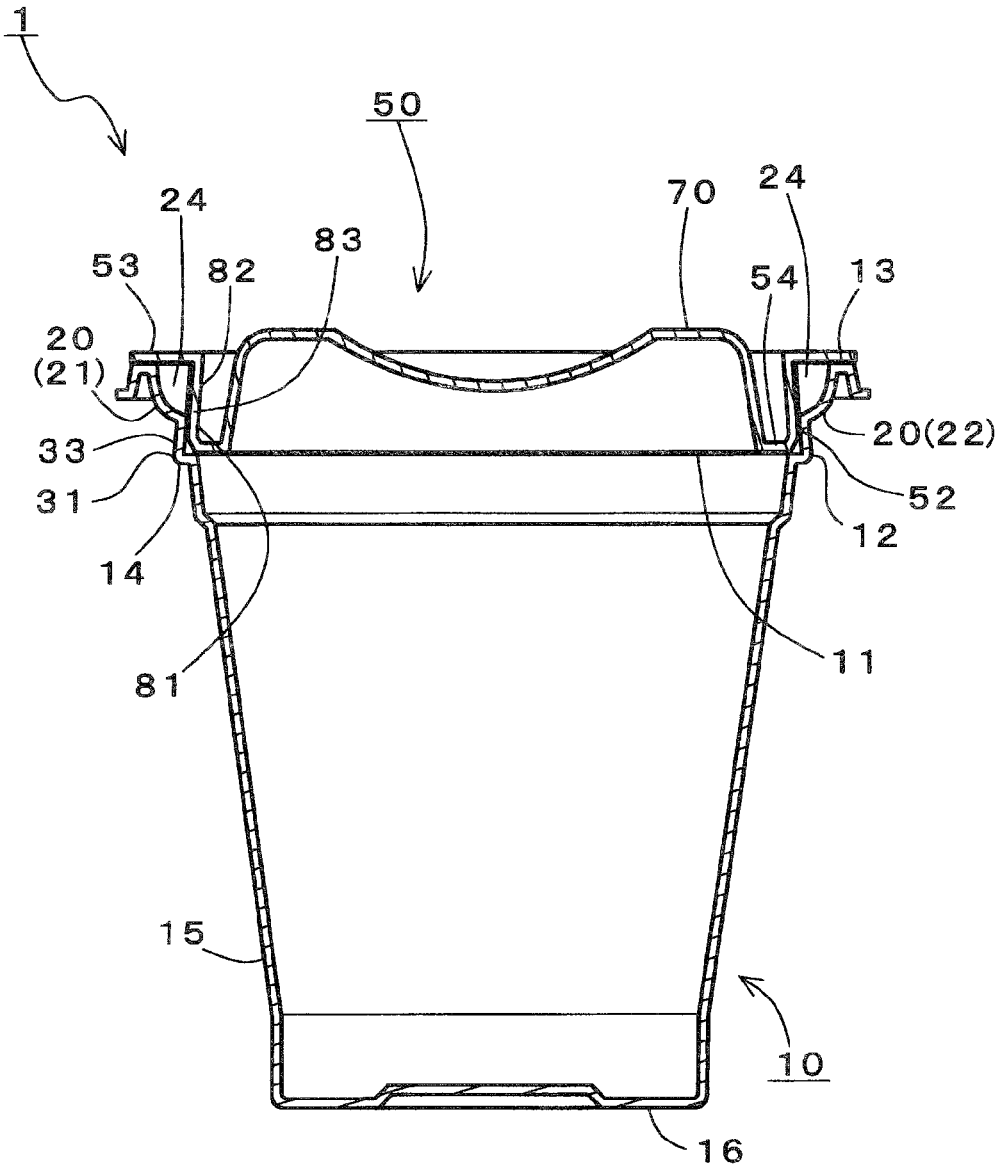
FIG. 7 is a longitudinal sectional view showing the beverage container in a closed state according to the invention.
Figure 9:
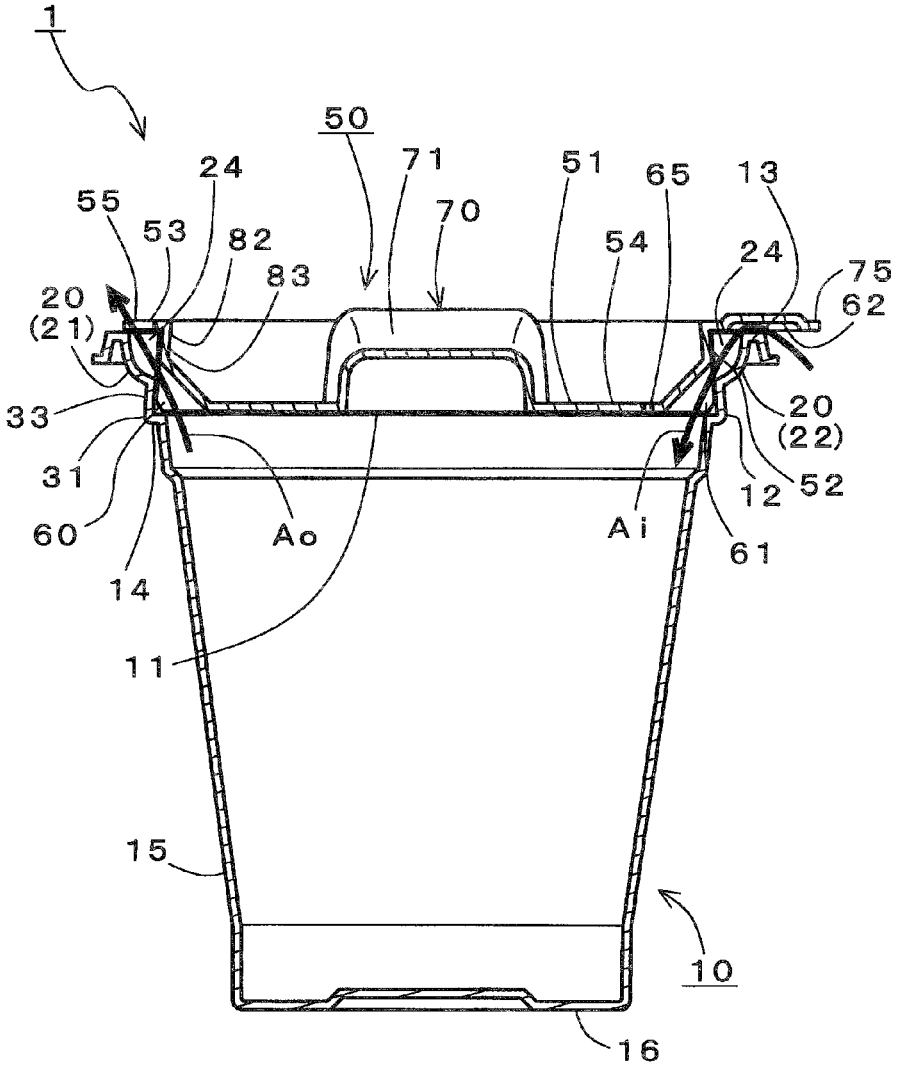
FIG. 9 is a longitudinal sectional view showing the beverage container in an open state according to the invention.

As shown in FIG. 2 (plan view) and FIG. 3 (perspective view) the container main body 10 is provided with an inner circumference sliding part 12 provided on the inside of an upper opening 11 and an outer circumference flange part 13 (container flange part) extending on the outside of the inner circumference sliding part 12. The side surface of the container body 10 defines a barrel part 15, the bottom surface defines a base part 16, and the container main body 10 is in the form of a cup. The inner circumference sliding part 12 and the barrel part 15 are connected via the inner circumference step part 14. Moreover, the inner circumference sliding part 12 and the outer circumference flange part 13 of the container main body 10 are provided with pouring recesses 20 which are formed from partial recesses 24 for pouring out a beverage contained in the container main body 10. The recess parts 20 form channels for a beverage. For the purpose of the beverage flowing smoothly, the partial recesses 24 are formed in both the inner circumference sliding part 12 and the outer circumference flange part 13 and are defined by recesses each having a gently curved L-shape in section (FIG. 7 and FIG. 9).

Two pouring recess parts are formed in the container main body 10 to be diametrically opposed to each other. Namely, they are positioned on a circle of the upper opening 11 at an angular distance of 180° (degrees). As will be mentioned later, when the beverage is poured out of one of the pouring recesses 20, the other pouring recess 20 forms a channel for air. Both pouring recesses 20 have the same shape and as a matter of convenience are referred to as the first pouring recess 21 and the second pouring recess 22. The sleeve receiving part is marked as 41 in FIG. 3.

Figure 4:
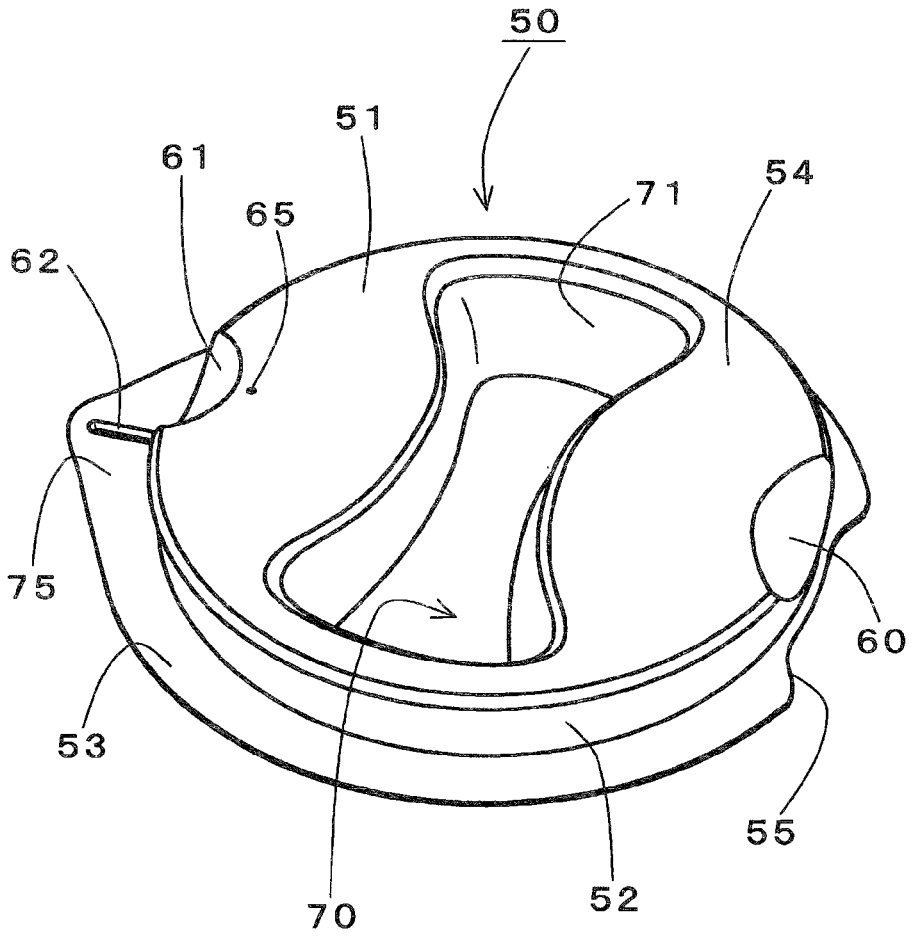
FIG. 4 is an oblique view showing the back side of the lid body according to the invention.

As may be seen in FIGS. 2 and 4 (perspective view from the back side) the lid body 50 is provided with an inner fitting part 52 detachably and rotatably attached to the inner circumference sliding part 12 and the outer circumference flange part 13 of the container main body 10. Further, the lid body 50 is provided with a drinking hole connecting part 60 which is brought in a position corresponding to the pouring recess 20 of the container main body 10 in accordance with the rotation of the lid body 50. The lid body 50 is shaped so that it can be fitted into the inside of the inner circumference sliding part 12 of the container main body 10. Accordingly, lid surface part 51 is depressed further down than the lid flange part 53 to form a lid stepped part 54 and an inner fitting part 52. In FIG. 4 which shows the lid body 50 viewed from the rear side, the lid surface part 51 protrudes upward.

As mentioned above, the drinking hole connecting part 60 which corresponds to one of the pouring recess parts 20 (either of 21 or 22) is formed in the lid body 50. In addition an outside air connecting part 61 is formed to correspond to the other pouring recess part 20. The drinking hole connecting part 60 forms a passage for the beverage and the outside air connecting part forms a passage for air. The drinking hole connecting part 60 and the outside air connecting part 61 are diametrically opposed to each other at an angular distance of 180° (degrees) on a circle of the inner fitting part 52 (on the diameter), in the same arrangement as the two pouring recesses 20. The drinking hole connecting part 60 is a passage for the beverage and thus is made larger than the outside air connecting part 61. Specifically, the connecting parts are formed by cutting the lid stepped part 54 into a curved surface shape. When drinking a beverage through the drinking hole connecting part 60, the lid flange part 53 which covers the pouring recess 20 is obstructive, therefore a flange cut-away part 55 is formed in the lid flange part 53 corresponding to the opening of the pouring recess 20 of the outer circumferential flange part 13.

After the lid body 50 is fitted onto the container main body 10, the pouring recesses 20 can be opened and closed in accordance with the rotation of the lid body 50 itself. To this end the lid body 50 is provided with a rotary knob 70 on the lid surface part 51 to rotate the lid body. As may be understood from FIGS. 2 and 4, lid rotary knob 70 has a rod shape with enlarged ends. A user of the beverage container 1 can rotate the lid body 50 either in the clockwise direction or in the counterclockwise direction by turning both the enlarged ends 71 of the rotary knob with his or her fingers. The lid body 50 is extremely easy to rotate due to the provision of the rotary knob 70 on the lid surface part 51.

Further, the lid body 50 is provided with an opening and closing tab 75. The lid part 50 is configured to have the lid flange part 53, thus, the opening and closing tab 75 is provided on the lid flange part 53. As the opening and closing tab 75 protrudes further out than the outer circumference flange part 13 of the container main body 10 at the time of fitting, when removing the lid body 50 which has been affixed to the container main body 10, the lid body 50 can be easily removed by pulling up the opening and closing tab 75. The easy removal of the lid body is useful for example, when adding to the beverage.

Further, the opening and closing tab 75 illustrated in the drawings, is positioned opposite the flange cut-away part 55. When the flange cut-away part 55 is registered with one of the pouring recesses 20, the opening and closing tab 75 is positioned at the other pouring recess 20. Because of this, a connecting hole (a connecting groove) 62 is formed in the lid flange part 53 of the opening and closing tab 75. The connecting hole 62 defines an air channel which allows air from outside the beverage container 1 to be introduced into the container main body 10 along with the outside air connecting part 61 to thereby eliminate the pressure difference between the inside and the outside of the container and facilitate the flowing out of the contained beverage from the pouring recess 20 and the drinking hole connecting part 60.

In addition, an air discharge part 65 is formed in the lid body 50. The air discharge part 65 forms a vent for steam after affixing the lid body 50 to the container main body 10. When the container main body 10 is filled with a hot beverage and the lid body 50 is affixed thereon, steam which is generated fills the inside of the beverage container 1. Consequently, the pressure inside the container rises and there is a possibility of the lid body 50 unintentionally coming off. To prevent this the air discharge part 65 provides a small hole large enough to reduce the pressure in the container.

In addition, not illustrated in the drawings, arrows or words (e.g. "turn") etc. which represent the direction of rotation may be added to the lid surface part 51 or the rotary knob 70 of the lid body 50. Further, words indicating where to drink from may be added (e.g. "drink from here") etc. Still further, a warning (e.g. "hot") can be appropriately added in the case of hot drinks. In addition, braille or universal design may be added to indicate the aforementioned information.

Figure 5:
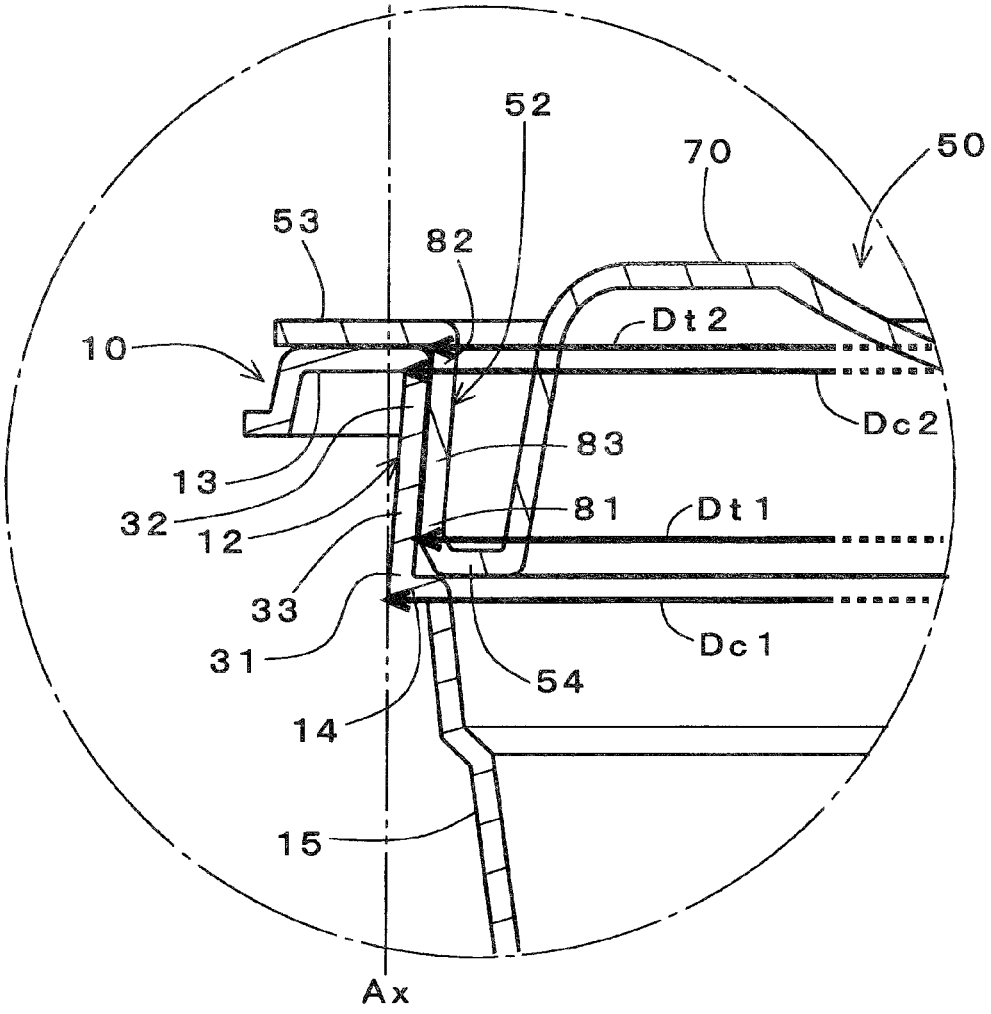
FIG. 5 is an enlarged partial cross-sectional view showing the inner circumference sliding part and inner fitting part according to the invention.

FIG. 5 shows an enlarged partial cross-sectional view of the inner circumference sliding part 12 of the container main body 10 and the inner fitting part 52 of the lid body 50 when affixed. The upper portion of the inner circumference sliding part (the upper opening 11 side) is slightly narrower than the lower portion. In the same way, the upper portion of the inner fitting part 52 is slightly narrower than the lower portion. As can be understood from the drawings, the cross sections of both the inner circumference sliding part 12 and the inner fitting part 52 are both circular so as to allow tree rotation. Therefore, the respective portions can be represented based on the size of the diameters thereof. Namely, the lower diameter Dc1 which is the diameter of the bottom end 31 of the inner circumference sliding part 12 is larger than the upper diameter Dc2 which is the diameter of the top end of the inner circumference sliding part 12 (Dc1>Dc2). In the same way, the lower diameter Dt1 which is the diameter of the lower end 81 of the inner fitting part 52 is larger than an upper diameter Dt2 which is the diameter of the upper end 82 of the inner fitting part 52 (Dt1>Dt2).

The inner circumference sliding part and the inner fitting part are not necessarily limited to the shapes illustrated in the drawings, provided that, as will be discussed later, for the convenience of molding, they are formed to have wall surfaces i.e., the inner circumference sliding part wall 33 and the inner fitting part wall 83. The inclination angle of the inner circumference sliding part 12 and the inner fitting part 52 which are inwardly inclined from the vertical axis Ax in the vertical direction of the container is approximately in the range of between 1 and 7 degrees. The inclination angle is determined taking into account the draft upon removal from the mold, the ease of fitting the lid body, the shape and size of the container etc. Further, as the inner circumference sliding part wall 33 of the inner circumference sliding part 12 contacts the inner fitting part wall 83 of the inner fitting part 52 or the lower end 81, the sealability of the container improves with the close contact between the two. Therefore it is difficult for the beverage to leak out from the beverage container 1.

Further, if the beverage container 1 is knocked over or dropped from a table, the outer circumference flange part 13 of the container main body 10 impacts the table or the ground. In this case, the force of impact is transferred from the outer circumference flange part 13 to the inner fitting part 52. Here, as mentioned before, as the upper opening 11 side of the inner circumference sliding part 12 of the container main body 10 is made narrower, the inner fitting part 52 is pushed to the lower side of the inner circumference sliding part 12 due to the force of impact, as a result the join between the inner circumference sliding part 12 and the inner fitting part 52 becomes stronger. Therefore, the beverage container, once the lid body is affixed on the container main body, can suppress the spillage of beverage even with the impact of being knocked over or dropped or the like.

In the case that once the inner fitting part 52 of the lid body 50 is fitted to the inner circumference sliding part 12 of the container main body 10, the lid body 50 is difficult to be removed accidentally from the container main body 10. Specifically, when removing the lid body 50, the lower end 81 of the inner fitting part 52 tends to move. However, the upper end 32 of the inner circumference sliding part 12 acts to resist the movement of the lower end 81. Therefore, the movement of the lower end 81 of the inner fitting part 52 is suppressed and the easy removal of the lid body 50 is suppressed. Further, as is clear, a moderate amount of resistance is encountered when fitting the lid body 50 on the container main body 10. However, when affixing the lid body 50, after the lower end 81 of the inner fitting part 52 of the lid body 50 passes the upper end 32 of the inner circumference sliding part 12, the inner fitting part 52 fits effortlessly and naturally into the inner circumference sliding part 12. Therefore a user of the beverage container of this invention may sense a click from the sound, touch, resistance and the like caused when affixing the lid body, while easily being able to confirm the fit of the lid.

Figure 6:
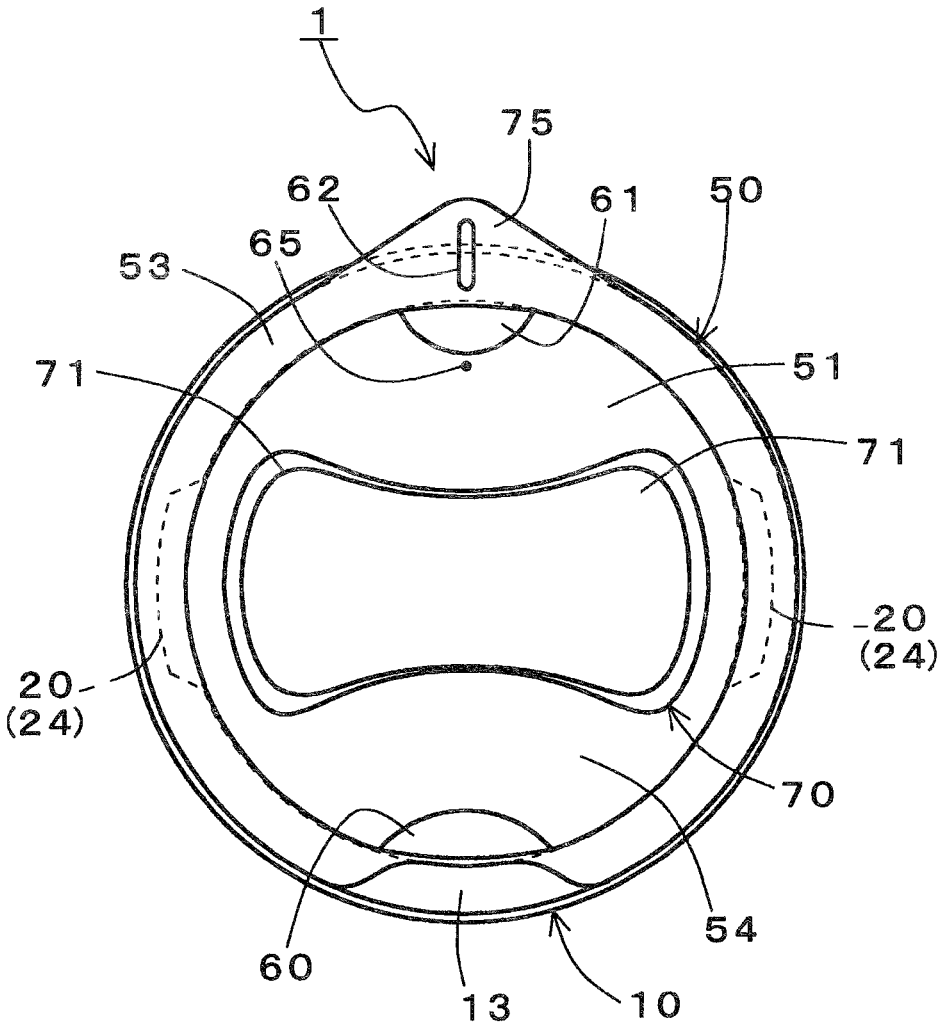
FIG. 6 is a plan view showing the beverage container in a closed state according to the invention.

With reference to FIGS. 6 to 9, the beverage container of the present invention during use will be described. FIG. 6 shows a plan view of the beverage container 1, and FIG. 7 shows a longitudinal sectional view of the beverage container 1. The lid body 50 of FIG. 7 corresponds to a cross section taken along the line X-X in FIG. 2(*a*) and the container main body 10 corresponds to a cross section taken along the line Z-Z of FIG. 2(*b*). In FIGS. 6 and 7, the lid body 50 is fitted and sealed on the container main body 10. This state is especially for when beverages are being sold and the like to prevent spilling. In the container main body 10 of FIG. 6, both the partial recesses 24 of the pouring recess parts 20 are covered by the lid flange part 53 of the lid body 50.

Further, as shown in FIG. 7, the hollow of the partial recess 24 formed in the inner circumference sliding part 12 is provided not in the whole of the inner circumference sliding part wall in the vertical direction, but in the portion other than the vicinity of the lower end 31 of the inner circumference sliding part 12 (the lower side of inner circumference sliding part wall 33). As the inner circumference sliding part wall 33 and the inner fitting wall 83 of the inner fitting part 52 or the lower end 81 thereof are in contact (close contact) with each other, the fit between the container main body 10 and the lid body 50 is high. Further, the lower end 31 of the inner circumference sliding part 12 extends continuously in the circumferential direction. Therefore, the sealability of the beverage container is maintained and the beverage contained therein cannot easily spill from the upper opening.

Figure 8:
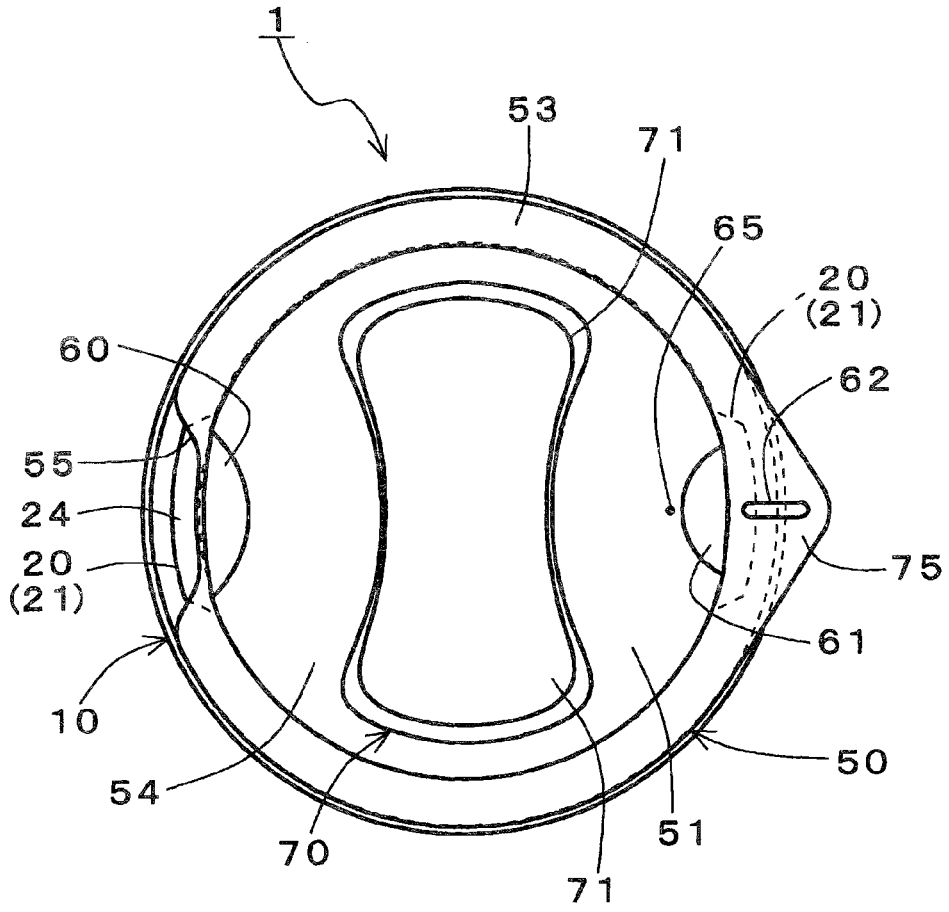
FIG. 8 is a plan view showing the beverage container in an open state according to the invention.

FIG. 8 shows a plan view of the beverage container 1 and FIG. 9 shows a longitudinal sectional view of the beverage container 1. The lid body 50 of FIG. 9 corresponds to a cross-section taken along the line Y-Y of FIG. 2(*a*) and the container main body 10 corresponds to a cross-section taken along the line Z-Z of FIG. 2(*b*). In FIGS. 8 and 9, the lid body 50 is attached to the container main body 10. Specifically, in FIGS. 8 and 9 the lid body 50 has been moved so that the beverage may be drunk. Compared to FIG. 6, FIG. 8 shows the lid body 50 has been turned 90 degrees. Specifically, the user hooked the rotary knob 70 with his/her fingers and turned the same until the flange cut-away part 55 reaches directly above the pouring recess 20 (partial recess 24). As a result, one of the pouring recesses 20 (first pouring recess 21 in the drawings) is exposed from the lid flange part and the connecting hole 62 formed in the lid flange part 53 is positioned directly above the other pouring recess 20 (second pouring recess 22 in the drawings).

As can be seen in FIG. 9, the partial recess 24 of the pouring recess 20 (first pouring recess 21) faces the drinking hole connecting part 60 which is formed on the lid stepped part 54 of the lid body 50. As a result, a channel extending from the inside of the beverage container 1 to the outer circumference flange part 13 through the drinking hole connecting part 60 and the recess part 20 is formed for the beverage. Namely, when a user wants to drink a beverage from the beverage container 1, the user puts his or her mouth to the outer circumference flange part 13 of the pouring recess 20 which is in the vicinity of the flange cut-away part 55, and inclines the beverage container 1, so that the beverage contained therein will naturally flow into the mouth. (Arrow Ao in FIG. 9). At the same time, the outside air connecting part 61 formed in the lid stepped part 54 of the lid body 50 is opposed to the partial recess 24 of the pouring recess 20 (second pouring recess 22). Further, the upper end of the partial recess 24 is formed partially on the outer circumference flange part 13. Therefore, a channel for air is established extending from the outside of the beverage container 1 to the outside air connecting part 61 through the connecting hole 62 and the partial recess 24 (Arrow Ai in FIG. 9). Namely, the beverage can smoothly flow due to no pressure difference occurring between the inside and outside of the beverage container 1.

In the case undrunk beverage remains in the beverage container 1, the pouring recess 20 can be closed by rotating the lid 50 to a position where the pouring recess 20 cannot be seen through the flange cut-away part 55. Thus, a user can drink the beverage from the beverage container 1 whenever required. Furthermore, as the portion of the outer circumference flange part 13 that is located in the vicinity of pouring recess 20 is covered by the lid flange part 53 of the lid body 50, exposure thereof can be hygienically avoided.

In the beverage container discussed above, the lid body is made from a well-known resin sheet, specifically, synthetic resin sheets such as polyethylene, polypropylene, polystyrene, polyethylene-terephthalate or biodegradable synthetic resin sheets such as polylactic acid can be used. The thickness of the synthetic sheet may be appropriately determined, and is generally 1.5 mm or less. The synthetic sheets are formed into the lid bodies having the shapes illustrated by vacuum forming.

Regarding the container main body, as long as the shape illustrated is maintained, there is no limitation on the material used. For example, paper, wood, metal and other resins can be used. From among these, a molded article of a well-known resin sheet, can be used in the same manner as the lid body. This can be formed into the shape of the container main body by vacuum forming as illustrated.

The formation of both the container main body and the lid body with the aforementioned resin sheets, can not only reduce the cost of materials, but also make mass production feasible thus leading to a reduction of production unit price. Therefore, the beverage containers of the present invention they can be used as disposable beverage containers used for take-out drinks. Because they are used only once, they are hygienic.

The exact types of beverage which can fill the beverage container are not specifically limited. The beverages can be water, soft drinks such as juice or soda, milk based drinks, alcoholic drinks, cocktails and other specialty drinks from any other region and the like. As previously mentioned, the beverage container is extremely useful at preventing spillages even if there is left-over drink by a simple operation on the lid body. It is suitable for hot beverages such as coffee, black tea, various types of tea, cocoa, hot chocolate, hot milk, spiced mulled wine (Glühwein) and other heated alcoholic beverages, further it can be used as a container for soups. In the case of cold beverages, the beverage can be drunk by a straw being inserted through the lid body. However, in the case of hot beverages, drinking through a straw is rare, and the beverage is drunk directly from the beverage container (cup).

If being used for hot beverages, this is extremely useful as it can prevent leakage through the lid body of the beverage container and can maintain sealability when some beverage remains. In addition, as may be understood from FIG. 9 etc. the lid body is fitted on the inside of the container main body, and accordingly the total height of the beverage container itself is almost the same as the height of the container main body. Namely, when the user tries to drink the beverage, the inconsistency of the feeling for the actual surface of the beverage relative to the incline of the container disappears. Especially when a user tries to drink a hot drink, spilling the beverage or unintentionally swallowing hot beverage, which would otherwise occur by tilting the container more than necessary can be effectively prevented as the incline of the beverage container is the same as that of the container main body.

Figure 10:
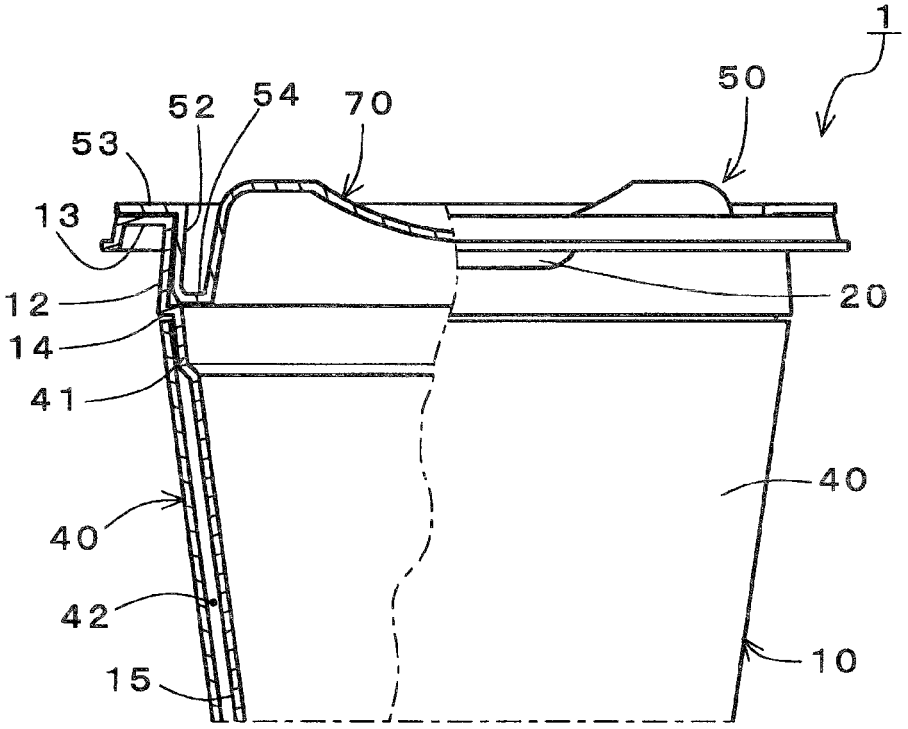
FIG. 10 is a tectonic sectional view showing the container main body fitted with a sleeve according to the invention.

In the structural cross-sectional view of FIG. 10, a sleeve 40 is attached to the barrel 15 of container main body 10 to cover the outer circumferential area of the barrel part 15. The sleeve 40 is in the form of a cylinder having a truncated cone shape which contacts a sleeve receiving part 41 which projects stepwise. The sleeve 40 is connected to the sleeve receiving part 41 by an adhesive or double-sided adhesive tape as necessary. Here, a gap 42 is formed between the sleeve 40 and the barrel part 15 of the container main body 10. If the container main body 10 is formed from a resin sheet, as the thickness of the resin sheet is small, the heat of the hot beverage will go through the barrel part 15 to the user's hand, and because of the heat, the user will be unable to hold the container main body 10. To prevent this, when the sleeve 40 is affixed to the outer circumferential surface of the barrel part 15, direct heat conduction tends not to occur due to the presence of the gap 42 and the user tends not to feel hot when the container is held by a hand. Considering the specific heat of the sleeve 40, the sleeve can be made of paper and the like whose surface can appropriately be printed on. Further, a separate effect can be achieved by the sleeve 40 when the container main body is filled with a cold drink. Usually, condensation occurs on the barrel part 15 when the container main body is filled with a cold drink and ice. However, as the sleeve 40 is provided, not only can the heat conduction of the coldness of the cold drink be suppressed, but also the user can hold the beverage container 1 in his or her hand without getting his or her hand wet due to the water droplets formed by condensation.

Figure 11:
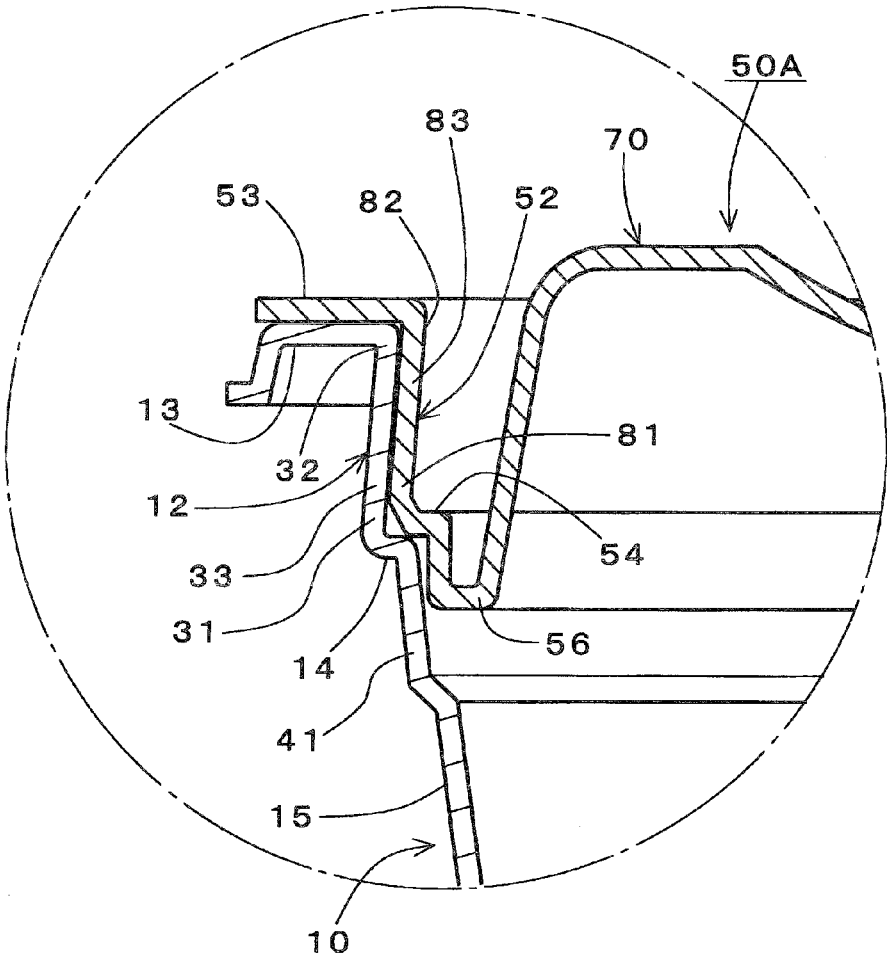
FIG. 11 is an enlarged partial cross-sectional view showing another example of a lid body according to the invention.

FIG. 11 is an enlarged partial longitudinal section showing another example of the lid body 50A attached to the container main body 10. The parts corresponding to those of the aforementioned lid body 50 are assigned the same reference numerals. An auxiliary stepped part 56 is provided on the lid surface part 51 of the lid body 50A. In the illustrated embodiment, the auxiliary stepped part 56 is provided on the lid stepped part 54 which is located lower than the lid surface part 51. The position where the auxiliary stepped part 56 is formed on the lid surface part 51 (the lid stepped part 54) is beneath and slightly inward of the inner fitting part 52, and the auxiliary stepped part 56 is circular excluding the drinking hole connecting part 60 and the outside air connecting part 61. The inner circumference sliding part 12 and the inner fitting part 52 are relatively firmly and securely affixed. Due to the addition of the auxiliary stepped part 56, the gap formed due to the difference between the inner circumference step part 14 below the inner circumference sliding part 12 and the body part 15 (the sleeve receiving part 41 in the illustrated embodiment) is filled. Because of this, the fitting performance can be increased. In addition, the auxiliary step part 56 enhances the structural strength of the lid body 50 and increases the resistance to bending deformation. Note, the structure of the inner fitting part of the lid body which is detachably attached and rotatably fitted to the inner circumference sliding part of the container main body is not necessarily limited to the illustrated structure, and can be replaced with well known fitting structures. For example, a multistage structure wherein both the lid body and the container body are provided with projections and recesses can be used.

INDUSTRIAL APPLICABILITY

The present invention provides a highly useful beverage container having a lid which is easy to drink from and has an increased sealability of the beverage contained within which has been left undrunk to thereby prevent spillages.

What is claimed is:

1. A beverage container comprising a container main body which is provided with an inner circumference sliding part provided on an inside of an upper opening and an outer circumference flange part extending on an outside of the inner circumference sliding part, and a lid body which is provided with an inner fitting part detachably and rotatably attached to said inner circumference sliding part and said outer circumference flange part of said container main body, wherein a pouring recess composed of a partial recess for pouring out a beverage contained in said container main body is formed in said inner circumference sliding part and said outer circumference flange part of said container main body, and a drinking hole connecting part is formed corresponding to said pouring recess of said container main body in accordance with the rotation of said lid body.

2. The beverage container according to claim 1 wherein, said container main body is provided with two pouring recesses which are opposed to each other, and said lid body is provided with the drinking hole connecting pan corresponding to one of the pouring recesses and an outside air connecting part corresponding to the other pouring recess.

3. The beverage container according to claim 1 wherein a lower part diameter (Dc1) of said inner circumference sliding part is larger than an upper part diameter (Dc2) of said inner circumference sliding part, and, a lower part diameter (Dt1) of the inner fitting part is larger than an upper part diameter (Dt2) of said inner fitting part, said inner fitting part of said lid body is fitted to the inside of said inner circumference sliding part of said container body.

4. The beverage container according to claim 1 wherein said lid body is provided with a rotary knob for rotating said lid body.

5. The beverage container according to claim 1 wherein an air discharge part is formed in the lid body.

6. The beverage container according to claim 1 wherein said lid body is provided with an opening, and closing tab which can be adapted to remove said lid body.

7. The beverage container according to claim 1 wherein said lid body is provided with an auxiliary stepped part formed on the surface thereof.

8. The beverage container according to claim 1 further comprising, a sleeve which covers the outer peripheral surface of the body part of the container main body.

9. The beverage container according to claim 1 wherein said beverage container is for hot beverages.

10. The beverage container according to claim 1 wherein the beverage container is disposable.

* * * * *